US012624514B2

(12) United States Patent
Ray et al.

(10) Patent No.: US 12,624,514 B2
(45) Date of Patent: May 12, 2026

(54) WOVEN SILT FENCES INCLUDING INTEGRALLY WOVEN POCKETS FOR SUPPORT POSTS

(71) Applicant: Willacoochee Industrial Fabrics, Inc., Willacoochee, GA (US)

(72) Inventors: Kevin William Ray, Willacoochee, GA (US); Eric Lee Booth, Willacoochee, GA (US); Melissa Grace, Gulf Breeze, FL (US)

(73) Assignee: Willacoochee Industrial Fabrics, Inc., Nashville, GA (US)

( * ) Notice: Subject to any disclaimer, the term of this patent is extended or adjusted under 35 U.S.C. 154(b) by 461 days.

(21) Appl. No.: 18/120,699

(22) Filed: Mar. 13, 2023

(65) Prior Publication Data

US 2023/0304249 A1 Sep. 28, 2023

Related U.S. Application Data

(60) Provisional application No. 63/449,214, filed on Mar. 1, 2023, provisional application No. 63/322,543, filed on Mar. 22, 2022.

(51) Int. Cl.
*E02D 17/20* (2006.01)

(52) U.S. Cl.
CPC ..... *E02D 17/202* (2013.01)

(58) Field of Classification Search
None
See application file for complete search history.

(56) References Cited

U.S. PATENT DOCUMENTS 6,367,781 B1 4/2002 Flynn et al.

OTHER PUBLICATIONS

Silt Fence Products; winfabusa.com; Copyright 2022; 4 pages.
WINFAB® 100SF Product Data Sheet; www.winfabusa.com; Copyright 2021; 1 page.
WINFAB® 105SF Product Data Sheet; www.winfabusa.com; Copyright 2021; 1 page.
WINFAB® 1211F Product Data Sheet; www.winfabusa.com; Copyright 2021; 1 page.
WINFAB® 1215DT Product Data Sheet; www.winfabusa.com; Copyright 2021; 1 page.
WINFAB® 1216 Product Data Sheet; www.winfabusa.com; Copyright 2021; 1 page.

(Continued)

*Primary Examiner* — Sean D Andrish
(74) *Attorney, Agent, or Firm* — Harness, Dickey & Pierce, P.L.C.; Anthony G. Fussner

(57) ABSTRACT

Disclosed are exemplary embodiments of woven silt fences including integrally woven pockets for support posts. In exemplary embodiments, a woven silt fence fabric includes one or more integrated pockets integrally woven within the woven silt fence fabric. The one or more integrated pockets are configured for receiving one or more support posts therein. In exemplary embodiments, a woven silt fence comprises the woven silt fence fabric and one or more support posts configured to be received within corresponding ones of the one or more integrated pockets integrally woven within the woven silt fence fabric. The one or more support posts may be configured to be positioned within corresponding ones of the one or more integrated pockets and driven into the ground for supporting the woven silt fence without requiring any fasteners for attachment of the one or more support posts to the woven silt fence fabric.

44 Claims, 4 Drawing Sheets

(56) References Cited

OTHER PUBLICATIONS

WINFAB® 1216-36/06/1.5 Product Data Sheet; www.winfabusa.com; Copyright 2021; 1 page.
WINFAB® 2014 Product Data Sheet; www.winfabusa.com; Copyright 2021; 1 page.
WINFAB® 2015 Product Data Sheet; www.winfabusa.com; Copyright 2021; 1 page.
WINFAB® 2098 Product Data Sheet; www.winfabusa.com; Copyright 2021; 1 page.
WINFAB® 2098-36/04/2-M Product Data Sheet; www.winfabusa.com; Copyright 2021; 1 page.
WINFAB® 2098R Product Data Sheet; www.winfabusa.com; Copyright 2021; 1 page.
WINFAB® 55SF Product Data Sheet; www.winfabusa.com; Copyright 2021; 1 page.
WINFAB® 77SF Product Data Sheet; www.winfabusa.com; Copyright 2021; 1 page.
WINFAB® V23 Product Data Sheet; www.winfabusa.com; Copyright 2021; 1 page.
WINFAB® V24 Product Data Sheet; www.winfabusa.com; Copyright 2021; 1 page.
Erosion Control—Biodegradable straw erosion control blanket; https://rolanka.com/erosion-mat-biodegradable-straw/BioD-StrawTM; May 21, 2020; 2 pages;.
Erosion Control Blanket for Banks/Biodegradable stsraw blanket; https://www.erosioncontrol-products.com/; May 21, 2020; 7 pages.
Wheat Straw Blanket/Natural Erosion Control; https://www.erosioncontrol-products.com/; May 21, 2020; 7 pages.
Canadian Office Action for CA3193710 that claims priority to the instant application; dated Aug. 30, 2024; 4 pages.

WOVEN SILT FENCES INCLUDING INTEGRALLY WOVEN POCKETS FOR SUPPORT POSTS

CROSS-REFERENCE TO RELATED APPLICATIONS

This application claims priority to and the benefit of U.S. Provisional Patent Application No. 63/322,543 filed Mar. 22, 2022 and U.S. Provisional Patent Application No. 63/449,214 filed Mar. 1, 2023. The entire disclosures of these provisional applications are incorporated herein by reference.

FIELD

The present disclosure relates to woven silt fences including integrally woven pockets for support posts.

BACKGROUND

This section provides background information related to the present disclosure which is not necessarily prior art.

Figure 1:
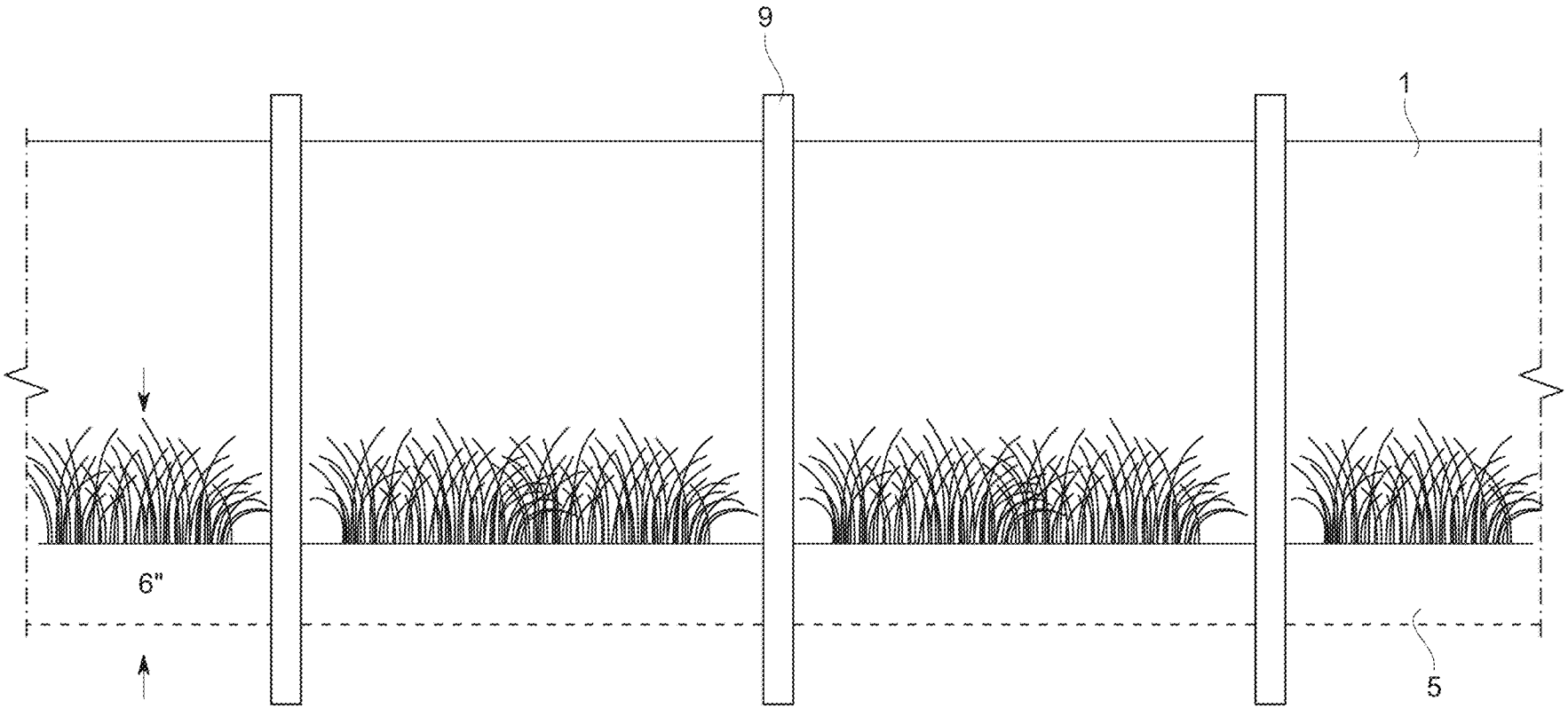
FIG. 1 (PRIOR ART)
Figure 2:
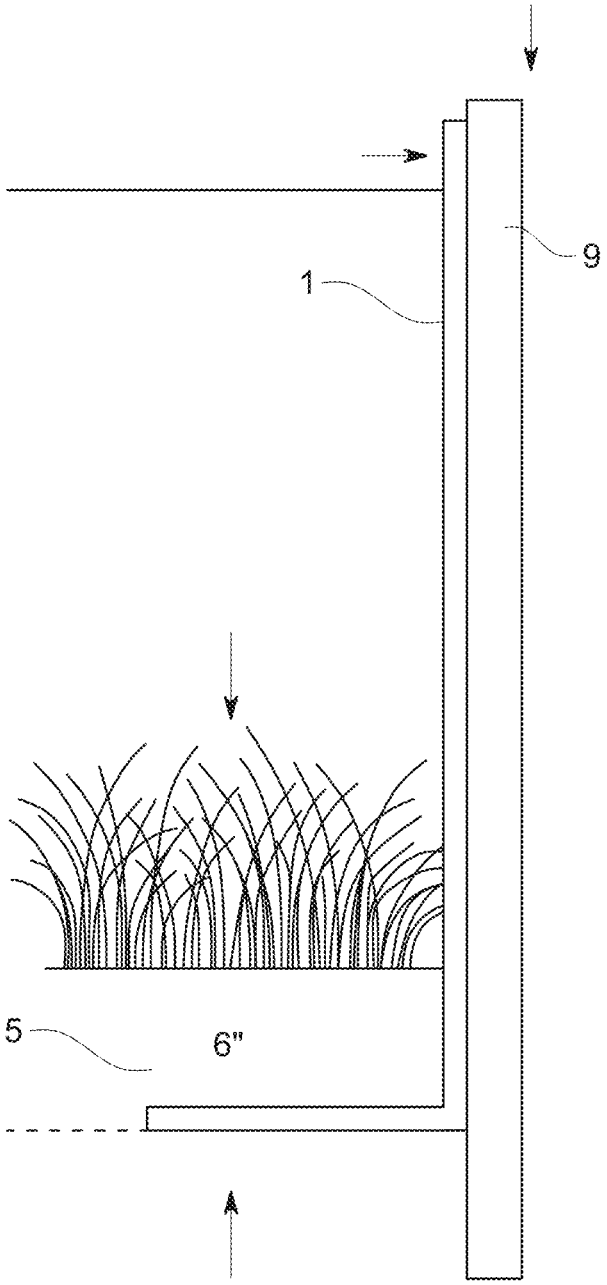
FIG. 2 (PRIOR ART)

Silt fences are commonly used in erosion control applications. A silt fence may also be referred to as a filter fence or sediment barrier. For example, FIGS. 1 and 2 illustrate a conventional silt fence 1 installed within a 6-inch deep trench 5 and supported by posts 9. By way of further example, Appendix A illustrates typical temporary silt fence specifications from the Department of Transportation for the State of Georgia. The contents of Appendix A is incorporated herein by reference in its entirety.

Conventionally, there are two different methods of deploying silt fences with posts/stakes. A first conventional method includes preassembling a silt fence fabric to the posts/stakes and then deploying the silt fence fabric and the preassembled posts/stakes at the site. In this first conventional method, the silt fence fabric including the attached posts/stakes are placed beside a trench. Installer(s) then manually place the silt fence fabric into the trench and individually drive the posts/stakes into the ground, which posts/stakes were previously attached or preassembled to the silt fence fabric prior to being driven into the ground.

A second conventional method includes burying a silt fence fabric in a trench, where the silt fence fabric does not include any posts/stakes previously attached or preassembled to the silt fence fabric. Instead, posts/stakes are driven into the ground adjacent to the silt fence fabric previously buried in the trench. The silt fence fabric is thereafter attached to the posts/stakes utilizing various types of fasteners. With this second conventional method, static slicing of the soil may be used during installation. But as recognized herein, the attachment process used to attach the silt fence fabric to the posts/stakes can result in the silt fence failing if the attachment is not performed correctly. And as further recognized herein, silt fences attached directly to wood, metal, or synthetic post/stakes with conventional fasteners can fail during the service life of the silt fence when exposed to common weather events such as heavy rains or high winds.

DRAWINGS

The drawings described herein are for illustrative purposes only of selected embodiments and not all possible implementations and are not intended to limit the scope of the present disclosure.

FIGS. 1 and 2 are front and side views of a conventional silt fence installed within a 6-inch deep trench and supported by posts.

Figure 3:
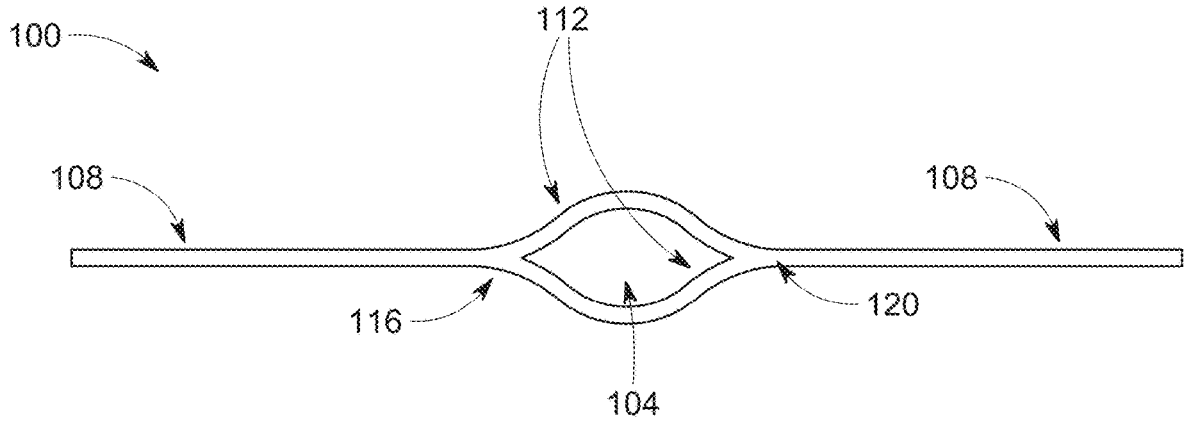

FIG. 3 illustrates a portion of a woven silt fence (broadly, woven geotextile fabric product) including an integrally woven open-ended pocket or sleeve (broadly, holder, containment compartment and/or device) to accommodate a support post or stake (broadly, support member or fill material) according to exemplary embodiments of the present disclosure. As disclosed herein, exemplary embodiments include pockets integrally formed from two or more layers of fabric woven in-line on the same loom (e.g., a flat loom, etc.) and from the same fabric used to weave the woven silt fence. By weaving the pockets in-line on the same loom as the woven fabric of the silt fence, the transition points or junctions between the woven silt fence fabric and the pockets do not require or necessarily include any manually applied staples, sewn seams, or other mechanical means for connection of the pockets to the woven fabric after the fabric(s) has been woven to create the silt fence.

Figure 4:
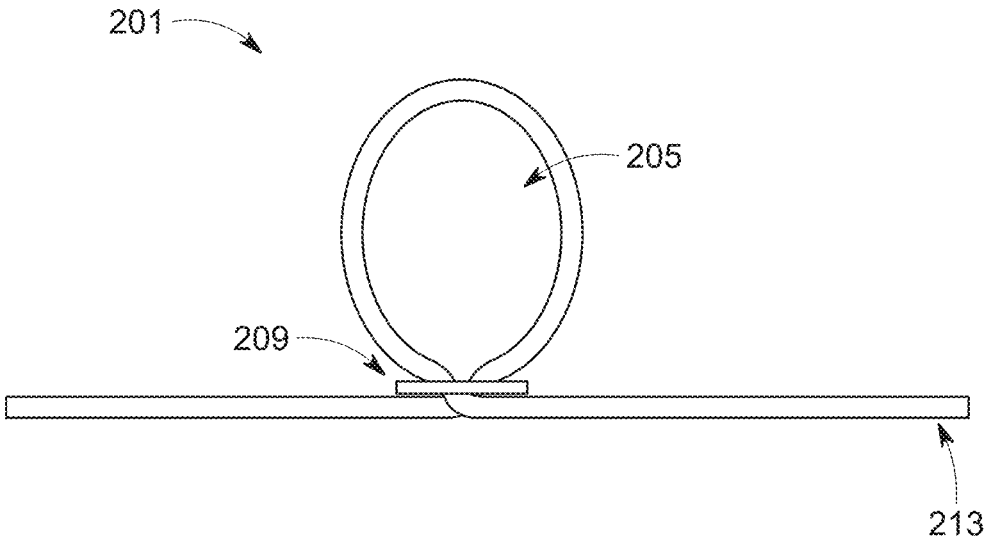
FIG. 4 (PRIOR ART)

FIG. 4 illustrates a portion of a conventional woven silt fence 201 including a support post pocket 205 that is manually sewn, stapled, or otherwise manually mechanically connected 209 to the silt fence after the fabric(s) 213 has been woven to create the silt fence. As shown in FIG. 4, the support post pocket 205 is connected or attached to the continuous woven fabric 213 of the silt fence 201 via a manually applied connection point 209, e.g., manually sewn seam or staple.

DETAILED DESCRIPTION

Example embodiments will now be described more fully with reference to the accompanying drawings.

Silt fences are commonly used in erosion control applications. For example, silt fence fabrics may be positioned adjacent to or generally around construction areas or other activities where native soils may be disturbed. When the soils are disturbed and it rains, the soil can "runoff" to waterways and contaminate the waters as well as result in significant erosion to the disturbed soils. A silt fence is a temporary erosion control product. When applied correctly, the silt fence fabric is buried in a trench made in the soil (e.g., 6 inches to 8 inches deep in the soil, etc.). The remainder or unburied portion of the silt fence fabric protrudes upwardly above the ground (e.g., with a height of 18 inches to 30 inches above the ground, etc.). The silt fence fabric is supported with posts or stakes (e.g., wood, metal, or synthetic posts or stakes, etc.) spaced apart from each other at various intervals along the silt fence. The posts/stakes are configured to maintain the silt fence upright and support the silt fence during the stress of moving soil/water. The silt fence is configured in a manner that will allow water to pass through while holding back the soil and sediment disturbed by the rain hence keeping the soil in place to limit runoff and erosion.

As disclosed herein, exemplary embodiments are generally directed to deployment of silt fences (and other products) using support posts/stakes (e.g., wood, metal, or synthetic posts/stakes, geotubes, other support members, etc.). Conventionally, there are two different methods of deploying silt fences with posts/stakes as described in the Background section above.

To aid in greatly reducing the above-noted silt fence failures, the industry has relied upon "pockets" in silt fences. Generally, a pocket is a loop of fabric that is sewn into the pre-formed silt fence. The pocket allows a wood, metal, or synthetic post/stake to be placed inside the pocket. The pockets facilitate the process of attaching the posts/stakes to the silt fence fabric, and the easier/better attachment process allows for an improved service life of the silt fence. Further, the positioning of the posts/stakes within the pockets provides better or greater support for the silt fence. The posts/stakes may be fully encompassed or substantially entirely contained within the fabric defining the pocket, which may provide significantly more support for the silt fence during common weather events such as heavy rain or high winds.

But as recognized herein, the conventional process of separately making the pockets in the silt fence fabric is an increased expense and requires further conversion after the silt fence fabric was manufactured. After recognizing the above, the inventors hereof developed and discloses herein exemplary embodiments of methods and systems for providing silt fences (broadly, woven geotextile fabric products) including integrally woven or integrated open-ended pockets or sleeve (broadly, holders, containment compartments and/or devices) configured for receiving support posts or stakes (broadly, support members or fill materials). As disclosed herein, the pockets are integrally formed or made during the initial manufacturing and weaving of the silt fence fabric. Advantageously, exemplary embodiments thus provide woven pocketed silt fences including pockets integrally woven with the silt fence fabric, without requiring a downstream conversion process of the silt fence fabric to create the pockets.

In exemplary embodiments, one or more pockets are created while a silt fence fabric is being woven for use as a silt fence. In such exemplary embodiments, the pockets are formed for the support posts/stakes by altering the weave pattern intermittently during weaving. Warp ends are manipulated with the weave in such a manner that fabric formation will shift from a single layer of fabric to two or more layers of fabric for a distance and then revert back to a single layer of fabric. The weave used, the size of the pockets in terms of area for accommodation of posts/stakes, and the spacing between the pocket formations (spacing between posts/stakes when the silt fence is installed) can vary. Further, the construction of the fabric in terms of yarns used in reference to size, type, raw material, and density of construction may also vary. Accordingly, in exemplary embodiments, the overall fabric design is not necessarily limited in any manner in its function to serve as a silt fence other than the silt fence fabric being woven to integrally include pockets for the support posts/stakes.

Weaving two layers of fabric is a known art in weaving. But as disclosed herein, exemplary embodiments include a unique way of weaving two or more layers of silt fence fabric intermittently for the purpose of integrally weaving pockets in the silt fence fabric (or other woven geotextile fabric product). By integrally weaving the pockets within the silt fence fabric, exemplary disclosed herein eliminate the additional steps of separately making the pockets after weaving of the silt fence fabric.

FIG. 3 illustrates a portion of an exemplary embodiment of a woven silt fence 100 (broadly, woven geotextile fabric product) including an integrally woven open-ended pocket or sleeve 104 (broadly, holder, containment compartment and/or device) to accommodate a support post or stake (broadly, support member or fill material). The pockets 104 are integrally formed with and spaced apart along a woven silt fence 100. The pockets are woven in-line on the same loom (e.g., a flat loom, etc.) and woven from the same fabric 108 used to weave the woven silt fence 100. FIG. 3 illustrates a silt fence fabric 108 with integrally woven pockets 104 for support posts. The open pocket 104 is formed between two or more layers of fabric 112 to accommodate support posts. A transition point 116 is shown from the woven fabric 108 to the two or more layers of fabric 116. Another transition point 120 is shown from the pocket 104 back to the woven fabric 108.

By weaving the pockets in-line on the same loom as the woven fabric 108 of the silt fence, transition points or junctions 116, 120 between the woven silt fence fabric and the pockets do not require or necessarily include any manually applied staples, sewn seams, or other mechanical means for connection of the pockets to the woven fabric after the fabric has been woven to create the silt fence. Accordingly, exemplary embodiments disclosed herein may therefore provide enhancements to the end product (e.g., woven silt fence, other woven geotextile fabric product, etc.) both from a functional standpoint and an economic/efficiency standpoint. For example, exemplary embodiments may allow for a more efficient manufacturing process that does not require manually connecting (e.g., via sewing seams, stapling, mechanically connecting, etc.) pockets separately to an already woven fabric.

Silt fencing is an effective, but temporary, erosion control solution for construction sites, hills, slopes, and areas that require sediment control and containment. For silt fencing to work effectively, the woven pocketed silt fences disclosed herein preferably comprise strong woven materials that offer high tensile strength and permeability. The woven pocketed silt fence is preferably configured such that water can continue to flow seamlessly through the woven silt fence fabric but individual particles are prevented from passing through the woven silt fence fabric. By way of example only, a woven pocketed silt fence disclosed herein may be made using UV-stabilized polypropylene yarn systems that are designed for effective silt retention and good (e.g., maximum, etc.) water flow. In alternative embodiments, a woven pocketed silt fence may be configured differently, e.g., made from a different yarn system besides a UV-stabilized polypropylene yarn system, etc.

The woven pocketed silt fences disclosed herein may primarily be used on construction sites in order to protect rivers, lakes, and streams, as well as other land resources from being contaminated by silt, sediment, and other construction debris. The woven pocketed silt fences disclosed herein may be configured for filtration, separation, and erosion protection applications. The woven pocketed silt fences disclosed herein may be configured to help prevent drain system clogging and silt pollution in waterways, as well as reduce the velocity of storm runoff. The woven pocketed silt fences disclosed herein may be easy to install and maintain and environmentally friendly thereby helping to ensure the project site remains compliant with the latest industry standards.

By way of example, FIGS. 1 and 2 illustrate a conventional silt fence 1 installed within a 6-inch deep trench 5 and supported by support posts 2. The support posts 2 may comprise wood, steel, other metal, or synthetic support posts that meet construction requirements and at the necessary or preferred spacing.

The posts 2 should be installed at a consistent depth as specified in the project requirements. The silt fence 1 is configured to provide a temporary sediment barrier where required. The silt fence barrier should be installed in conformance to project design plans and local, state, and/or federal guidelines.

The 6-inch depth of the conventional trench 5 shown in FIGS. 1 and 2 is provided as an example only as exemplary embodiments of the silt fences disclosed herein may be installed in differently sized trenches (e.g., deeper than 6 inches or 150 millimeters (mm), etc.), which are preferably deep and wide enough to allow the silt fence fabric to be placed in a "J". Generally, the trench and silt fence placement should follow the contour of the ground in which the silt fence is being installed. The trench should be backfilled with native soil and compacted over the silt fence such that flow does not travel under the fence. The silt fence should be long enough such that flow is not allowed around the end of the silt fence. Field splices should preferably overlap a minimum of 18 inches (450 mm). Requirements in the project design plans or local, state, and/or federal guidelines should also be followed. For example, Appendix A illustrates typical temporary silt fence specifications from the Department of Transportation for the State of Georgia. The contents of Appendix A is incorporated herein by reference in its entirety. In exemplary embodiments, a silt fence disclosed herein may be configured to have one or more features disclosed in Appendix A.

In exemplary embodiments, a woven silt fence fabric comprises yarns integrally woven together such that the yarns define one or more integrated pockets integrally woven within the woven silt fence fabric. The one or more integrated pockets are configured for receiving one or more support posts therein.

In exemplary embodiments, the yarns are integrally woven together such that the yarns define the one or more integrated pockets within the woven silt fence fabric without having to manually add the one or more integrated pockets separately to the woven silt fence fabric after weaving of the woven silt fence fabric.

In exemplary embodiments, the one or more integrated pockets are integrally woven within the woven silt fence fabric while the woven silt fence fabric is being initially woven from the yarns.

In exemplary embodiments, transition points between the woven silt fence fabric and the one or more integrated pockets do not include any manually applied staples or sewn seams connecting the one or more integrated pockets to the woven silt fence fabric.

In exemplary embodiments, the one or more integrated pockets are formed by altering a weave pattern intermittently during an initial weaving of the yarns into the woven silt fence fabric.

In exemplary embodiments, warp ends of the yarns are manipulated within the weave of the yarns in such a manner that fabric formation shifts from a single layer of woven silt fence fabric to two or more layers of woven silt fence fabric for a distance, and then reverts back to a single layer of woven silt fence fabric. The one or more integrated pockets are defined by the two or more layers of woven silt fence fabric.

In exemplary embodiments, the one or more integrated pockets are defined by two or more layers of the woven silt fence fabric intermittently woven from the yarns.

In exemplary embodiments, the one or more integrated pockets comprise a plurality of integrated pockets integrally woven within the woven silt fence fabric such that the one or more integrated pockets are spaced apart from each other along a length of the woven silt fence fabric.

In exemplary embodiments, the yarns comprises polypropylene yarn and/or a UV-stabilized yarn system. For example, the yarns may comprise a UV-stabilized polypropylene yarn system.

In exemplary embodiments, the one or more integrated pockets are integrally woven in a cross-machine direction along the woven silt fence fabric.

In exemplary embodiments, a woven silt fence comprises the woven silt fence fabric. The woven silt fence may further comprise one or more support posts configured to be slidably received within corresponding ones of the one or more integrated pockets integrally woven within the woven silt fence fabric. The one or more support posts may be configured to be slidably positioned within corresponding ones of the one or more integrated pockets and driven into the ground for supporting the woven silt fence without requiring any fasteners for attachment of the one or more support posts to the woven silt fence fabric and without having to manually add any separate pockets for the one or more support posts to the woven silt fence fabric.

In exemplary embodiments, the one or more integrated pockets comprise a plurality of integrated pockets integrally woven within the woven silt fence fabric such that the integrated pockets are spaced apart from each other along a length of the woven silt fence fabric. And the one or more support posts comprise a plurality of support posts each configured to be slidably positioned within a corresponding one of the plurality of integrated pockets.

In exemplary embodiments, a woven geotextile fabric product comprises a woven silt fence fabric as disclosed herein. The one or more integrated pockets are integrally woven within the woven silt fence fabric. The one or more integrated pockets are configured for receiving one or more support members therein.

In exemplary embodiments, a method includes weaving yarns together to thereby provide a woven silt fence fabric having one or more integrated pockets integrally woven within the woven silt fence fabric. The one or more integrated pockets configured for receiving one or more support posts therein.

In exemplary embodiments, the method includes weaving the yarns together in a single operation on a weaving machine to thereby provide the woven silt fence fabric having the one or more integrated pockets integrally woven within the woven silt fence fabric during the single operation on the weaving machine.

In exemplary embodiments, the method includes weaving the yarns together in-line on a loom to thereby provide the woven silt fence fabric having the one or more integrated pockets integrally woven within the woven silt fence fabric during the in-line weaving on the loom. The method may include weaving the yarns together in-line on the loom such that the one or more integrated pockets are integrally woven in a cross-machine direction within the woven silt fence fabric during the in-line weaving on the loom.

In exemplary embodiments, the method includes weaving the yarns such that the woven silt fence fabric having the one or more integrated pockets is provided as a single woven component that integrally includes the woven silt fence fabric and the one or more integrated pockets integrally woven together. Accordingly, pockets do not need to be manually added separately to the woven silt fence fabric after weaving of the woven silt fence fabric.

In exemplary embodiments, the method includes integrally weaving the one or more integrated pockets within the woven silt fence fabric while the woven silt fence fabric is being initially woven from the yarns. Transition points between the woven silt fence fabric and the one or more integrated pockets do not include any manually applied staples or sewn seams connecting the one or more integrated pockets to the woven silt fence fabric.

In exemplary embodiments, the method includes altering a weave pattern intermittently during an initial weaving of the yarns into the woven silt fence fabric such that the yarns define one or more integrated pockets integrally woven within the woven silt fence fabric.

In exemplary embodiments, the method includes manipulating warp ends of the yarns within the weave of the yarns in such a manner that fabric formation shifts from a single layer of woven silt fence fabric to two or more layers of woven silt fence fabric for a distance, and then reverts back to a single layer of woven silt fence fabric. The one or more integrated pockets are defined by the two or more layers of woven silt fence fabric.

In exemplary embodiments, the method includes intermittently weaving the yarns such that the one or more integrated pockets are defined by two or more layers of the woven silt fence fabric intermittently woven from the yarns.

In exemplary embodiments, the method includes weaving the yarns together to thereby provide a plurality of integrated pockets integrally woven within the woven silt fence fabric such that the integrated pockets are spaced apart from each other along a length of the woven silt fence fabric.

In exemplary embodiments, the method further comprises producing and preparing the yarns before weaving the yarns to thereby provide the woven silt fence fabric having the one or more integrated pockets integrally woven within the woven silt fence fabric.

In exemplary embodiments, the method further comprises positioning one or more support posts within corresponding ones of the one or more integrated pockets, e.g., without fastening the one or more support posts to the woven silt fence fabric. The method may further comprise driving the one or more support posts into the ground whereby the one or more support posts are operable for supporting the woven silt fence fabric.

In exemplary embodiments, the method includes weaving the yarns together to thereby provide a woven geotextile fabric product having the one or more integrated pockets integrally woven within the woven geotextile fabric product. The one or more integrated pockets are configured for receiving one or more support members therein.

In exemplary embodiments, a woven geotextile fabric product comprising yarns integrally woven together such that the yarns define one or more integrated containment compartments and/or devices integrally woven within the woven geotextile fabric product. The woven geotextile fabric product may comprise a wide range of products for various applications, such as geotextile containment compartments and/or devices, marine mattresses, gabion baskets, filter mattresses, scour mattresses, bastion units, geotextile tubes, sediment bags, dewatering bags, crane pads, rumble strips, trackout control mats, dump truck liners, container liners for transport, fabric formed concrete, ballast systems for pipelines and other infrastructure, flood protection systems, silt fences, etc.

In exemplary embodiments, the one or more integrated containment compartments and/or devices are configured for slidably receiving one or more support members therein.

In exemplary embodiments, the one or more integrated containment compartments and/or devices are configured receiving and containing a construction fill material therein. For example, the one or more integrated containment compartments and/or devices may be configured for receiving and containing stone fill, sand/soil fill, or a combination thereof.

In exemplary embodiments, the woven geotextile fabric product comprises a filtration fabric, an erosion control fabric, and/or a woven industrial fabric.

In exemplary embodiments, the one or more integrated containment compartments and/or devices comprise one or more of a pocket, a sleeve, a frame, a bastion, and/or a basket. For example, the one or more integrated containment compartments and/or devices may comprise one or more mattress product containment compartments and/or devices configured for capturing construction fill material, e.g., rock, soil, sediment, gravel, stone, sand, other fillers, aggregates thereof, etc.

In exemplary embodiments, the yarns are integrally woven together such that: the yarns define the one or more integrated containment compartments and/or devices within the woven geotextile fabric product without having to manually add the one or more integrated pockets separately to the woven geotextile fabric product; and/or transition points between the woven geotextile fabric product and the one or more integrated containment compartments and/or devices do not include any manually applied staples or sewn seams connecting the one or more integrated containment compartments and/or devices to the woven geotextile fabric product.

In exemplary embodiments, warp ends of the yarns are manipulated within the weave of the yarns in such a manner that fabric formation shifts from a single layer of fabric to two or more layers of fabric for a distance, and then reverts back to a single layer of fabric, whereby the one or more integrated containment compartments and/or devices are defined by the two or more layers of fabric.

In exemplary embodiments, the one or more integrated containment compartments and/or devices are defined by two or more layers of the woven silt fence fabric intermittently woven from the yarns; and/or the one or more integrated containment compartments and/or devices comprise a plurality of integrated open-ended pockets or sleeves integrally woven within the woven geotextile fabric product and spaced apart from each other along a length of the woven geotextile fabric product.

In exemplary embodiments, the yarns comprises polypropylene yarn and/or a UV-stabilized yarn system; and/or the one or more integrated containment compartments and/or devices are integrally woven in a cross-machine direction within the woven geotextile fabric product.

In exemplary embodiments, the woven geotextile fabric product comprises a woven silt fence including the one or more integrated containment compartments and/or devices integrally woven within the woven silt fence. The one or more integrated containment compartments and/or devices are configured to slidably receive one or more support posts therein. The one or more support posts are configured to be slidably positioned within corresponding ones of the one or more integrated containment compartments and/or devices and driven into the ground for supporting the woven silt fence without requiring any fasteners for attachment of the one or more support posts to the woven silt fence and without having to manually add any separate pockets for the one or more support posts to the woven silt fence.

In exemplary embodiments, a method comprises weaving yarns together to thereby provide a woven geotextile fabric product having one or more integrated containment compartments and/or devices integrally woven within the woven geotextile fabric product. The method includes: weaving the yarns together in a single operation on a weaving machine to thereby provide the woven geotextile fabric product having the one or more integrated containment compartments and/or devices integrally woven within the woven geotextile fabric product during the single operation on the weaving machine; and/or weaving the yarns together in-line on a loom to thereby provide the woven geotextile fabric product having the one or more integrated containment compartments and/or devices integrally woven within the woven geotextile fabric product during the in-line weaving on the loom. The woven geotextile fabric product may comprise a wide range of products for various applications, such as geotextile containment compartments and/or devices, marine mattresses, gabion baskets, filter mattresses, scour mattresses, bastion units, geotextile tubes, sediment bags, dewatering bags, crane pads, rumble strips, trackout control mats, dump truck liners, container liners for transport, fabric formed concrete, ballast systems for pipelines and other infrastructure, flood protection systems, silt fences, etc.

In exemplary embodiments, the one or more integrated containment compartments and/or devices are configured for slidably receiving one or more support members therein.

In exemplary embodiments, the one or more integrated containment compartments and/or devices are configured receiving and containing a construction fill material therein. For example, the one or more integrated containment compartments and/or devices may be configured for receiving and containing stone fill, sand/soil fill, or a combination thereof.

In exemplary embodiments, the woven geotextile fabric product comprises a filtration fabric, an erosion control fabric, and/or a woven industrial fabric.

In exemplary embodiments, the one or more integrated containment compartments and/or devices comprise one or more of a pocket, a sleeve, a frame, a bastion, and/or a basket. For example, the one or more integrated containment compartments and/or devices may comprise one or more mattress product containment compartments and/or devices configured for capturing construction fill material, e.g., rock, soil, sediment, gravel, stone, sand, other fillers, aggregates thereof, etc.

In exemplary embodiments, the method includes weaving the yarns such that the woven geotextile fabric product having the one or more integrated containment compartments and/or devices is provided as a single woven component that integrally includes the woven geotextile fabric product and the one or more integrated containment compartments and/or devices integrally woven together, without having to manually add the one or more integrated containment compartments and/or devices separately to the woven geotextile fabric product after weaving of the woven geotextile fabric product.

In exemplary embodiments, the method includes integrally weaving the one or more integrated containment compartments and/or devices within the woven geotextile fabric product while the woven geotextile fabric product is being initially woven from the yarns such that transition points between the woven geotextile fabric product and the one or more integrated containment compartments and/or devices do not include any manually applied staples or sewn seams connecting the one or more integrated containment compartments and/or devices to the woven geotextile fabric product.

In exemplary embodiments, the method includes altering a weave pattern intermittently during an initial weaving of the yarns into the woven geotextile fabric product such that the yarns define the one or more integrated containment compartments and/or devices integrally woven within the woven geotextile fabric product.

In exemplary embodiments, the method includes manipulating warp ends of the yarns within the weave of the yarns in such a manner that fabric formation shifts from a single layer of fabric to two or more layers of fabric for a distance, and then reverts back to a single layer of fabric, whereby the one or more integrated containment compartments and/or devices are defined by the two or more layers of fabric.

In exemplary embodiments, the method includes intermittently weaving the yarns such that the one or more integrated containment compartments and/or devices are defined by two or more layers of the fabric intermittently woven from the yarns.

In exemplary embodiments, the method includes weaving the yarns together to thereby provide a plurality of integrated containment compartments and/or devices integrally woven within the woven geotextile fabric product and spaced apart from each other along a length of the woven geotextile fabric product.

In exemplary embodiments, producing and preparing the yarns before weaving the yarns to thereby provide the woven geotextile fabric product having the one or more integrated containment compartments and/or devices integrally woven within the woven geotextile fabric product.

In exemplary embodiments, the method includes weaving the yarns together to thereby provide a woven silt fence having the one or more integrated containment compartments and/or devices integrally woven within the woven silt fence, the one or more integrated containment compartments and/or devices configured for receiving one or more support posts therein.

In exemplary embodiments, a method comprising providing a woven silt fence that includes a woven silt fence fabric having one or more integrated pockets integrally woven within the woven silt fence fabric, and one or more support posts positionable within the one or more integrated pockets.

In exemplary embodiments, the method includes positioning the one or more support posts into corresponding ones of the one or more integrated pockets without fastening the one or more support posts to the woven silt fence fabric and without having to manually add separate pockets to the woven silt fence fabric after weaving of the woven silt fence fabric.

In exemplary embodiments, the method further comprises driving the one or more support posts into the ground whereby the one or more support posts are operable for supporting for the woven silt fence. The method also includes burying a lower portion of the woven silt fence within a trench in the ground before driving the one or more support posts into the ground.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

The Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter parameter may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected, or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A woven silt fence fabric comprising interlaced warp yarns and weft yarns integrally woven together in-line on a loom such that the warp yarns and weft yarns define one or more integrated pockets integrally woven within the woven silt fence fabric and formed by intermittently weaving two or more woven layers from the same warp yarns and weft yarns and then returning to a single woven layer, the one or more integrated pockets configured for receiving one or more support posts therein.

2. The woven silt fence fabric of claim 1, wherein the warp yarns and weft yarns are integrally woven together such that the warp yarns and weft yarns define the one or more integrated pockets within the woven silt fence fabric without having to manually add the one or more integrated pockets separately to the woven silt fence fabric.

3. The woven silt fence fabric of claim 1, wherein the one or more integrated pockets are integrally woven within the woven silt fence fabric such that transition points between the woven silt fence fabric and the one or more integrated pockets do not include any manually applied staples or sewn seams connecting the one or more integrated pockets to the woven silt fence fabric.

4. The woven silt fence fabric of claim 1, wherein warp ends are manipulated during in-line weaving on the loom by intermittently altering the weave pattern so that fabric formation transitions from a single woven layer to two or more woven layers for a distance and then transitions back to a single woven layer, thereby defining the one or more integrated pockets by the two or more woven layers.

5. The woven silt fence fabric of claim 1, wherein the one or more integrated pockets are defined by two or more layers of the woven silt fence fabric intermittently woven from the warp yarns and weft yarns on the loom.

6. The woven silt fence fabric of claim 1, wherein the one or more integrated pockets comprise a plurality of integrated pockets integrally woven within the woven silt fence fabric and spaced apart from each other along a length of the woven silt fence fabric, each pocket being formed in-line by multi-layer weaving on the loom.

7. The woven silt fence fabric of claim 1, wherein:

the warp yarns and weft yarns comprises polypropylene yarn and/or a UV-stabilized yarn system; and/or the one or more integrated pockets are integrally woven in a cross-machine direction along the woven silt fence fabric.

8. A woven silt fence comprising the woven silt fence fabric of claim 1, and further comprising the one or more support posts configured to be slidably received within corresponding ones of the one or more integrated pockets and driven into the ground for supporting the woven silt fence without requiring any fasteners for attachment of the one or more support posts to the woven silt fence fabric and without having to manually add any separate pockets for the one or more support posts to the woven silt fence fabric.

9. A woven geotextile fabric product comprising the woven silt fence fabric of claim 1 having the one or more integrated pockets integrally woven within the woven geotextile fabric product.

10. A method comprising weaving, on a loom, interlaced warp yarns and weft yarns to thereby provide a woven silt fence fabric having one or more integrated pockets integrally woven within the woven silt fence fabric and formed in-line during weaving by intermittently creating two or more woven layers from the same warp yarns and weft yarns and then returning to a single woven layer, the one or more integrated pockets configured for receiving one or more support posts therein.

11. The method of claim 10, wherein the method includes weaving the warp yarns and weft yarns together in a single operation on the loom to thereby provide the woven silt fence fabric having the one or more integrated pockets integrally woven within the woven silt fence fabric during the single operation on the loom.

12. The method of claim 10, wherein the method includes weaving the warp yarns and weft yarns together in-line on the loom to thereby provide the woven silt fence fabric having the one or more integrated pockets integrally woven within the woven silt fence fabric during the in-line weaving on the loom.

13. The method of claim 12, wherein the method includes weaving the warp yarns and weft yarns together in-line on the loom such that the one or more integrated pockets are integrally woven in a cross-machine direction along the woven silt fence fabric during the in-line weaving on the loom.

14. The method of claim 10, wherein the method includes weaving the warp yarns and weft yarns such that the woven silt fence fabric having the one or more integrated pockets is provided as a single woven component that integrally includes the woven silt fence fabric and the one or more integrated pockets integrally woven together, without having to manually add the one or more integrated pockets separately to the woven silt fence fabric after weaving of the woven silt fence fabric.

15. The method of claim 10, wherein the method includes integrally weaving the one or more integrated pockets within the woven silt fence fabric while the woven silt fence fabric is being initially woven from the warp yarns and weft yarns such that transition points between the woven silt fence fabric and the one or more integrated pockets do not include any manually applied staples or sewn seams connecting the one or more integrated pockets to the woven silt fence fabric.

16. The method of claim 10, wherein the method includes altering a weave pattern intermittently during an initial weaving of the warp yarns and weft yarns into the woven silt fence fabric such that the warp yarns and weft yarns define the one or more integrated pockets integrally woven within the woven silt fence fabric.

17. The method of claim 10, wherein the method includes manipulating warp ends during weaving on the loom by intermittently altering the weave pattern so that fabric formation transitions from a single woven layer to two or more woven layers for a distance and then transitions back to a single woven layer, whereby the one or more integrated pockets are defined by the two or more woven layers.

18. The method of claim 10, wherein the method includes intermittently weaving the warp yarns and weft yarns such that the one or more integrated pockets are defined by two or more layers of the woven silt fence fabric intermittently woven from the warp yarns and weft yarns.

19. The method of claim 10, wherein:

the method includes weaving the warp yarns and weft yarns together to thereby provide a plurality of integrated pockets integrally woven within the woven silt fence fabric and spaced apart from each other along a length of the woven silt fence fabric; and/or the warp yarns and weft yarns comprises polypropylene yarn and/or a UV-stabilized yarn system; and/or the method further comprises producing and preparing the warp yarns and weft yarns before weaving the warp yarns and weft yarns to thereby provide the woven silt fence fabric having the one or more integrated pockets integrally woven within the woven silt fence fabric.

20. The method of claim 10, wherein the method includes:

positioning the one or more support posts within corresponding ones of the one or more integrated pockets without fastening the one or more support posts to the woven silt fence fabric; and driving the one or more support posts into the ground whereby the one or more support posts are operable for supporting the woven silt fence fabric.

21. The method of claim 10, wherein the method includes weaving the warp yarns and weft yarns together to thereby provide a woven geotextile fabric product having the one or more integrated pockets integrally woven within the woven geotextile fabric product.

22. A woven geotextile fabric product comprising interlaced warp yarns and weft yarns integrally woven together in-line on a loom such that the warp yarns and weft yarns define one or more integrated containment compartments and/or devices integrally woven within the woven geotextile fabric product and formed by intermittently weaving two or more woven layers from the same warp yarns and weft yarns and then returning to a single woven layer.

23. The woven geotextile fabric product of claim 22, wherein the one or more integrated containment compartments and/or devices are configured for slidably receiving one or more support members therein.

24. The woven geotextile fabric product of claim 22, wherein the one or more integrated containment compartments and/or devices are configured for receiving and containing a construction fill material therein.

25. The woven geotextile fabric product of claim 24, wherein the one or more integrated containment compartments and/or devices are configured for receiving and containing stone fill, a sand/soil fill, or a combination thereof.

26. The woven geotextile fabric product of claim 22, wherein the woven geotextile fabric product comprises a filtration fabric, an erosion control fabric, and/or a woven industrial fabric.

27. The woven geotextile fabric product of claim 22, wherein the one or more integrated containment compartments and/or devices comprise one or more of a pocket, a sleeve, a frame, a bastion, and/or a basket.

28. The woven geotextile fabric product of claim 22, wherein the warp yarns and weft yarns are integrally woven together such that:

the warp yarns and weft yarns define the one or more integrated containment compartments and/or devices within the woven geotextile fabric product without having to manually add the one or more integrated containment compartments and/or devices separately to the woven geotextile fabric product; and/or transition points between the woven geotextile fabric product and the one or more integrated containment compartments and/or devices do not include any manually applied staples or sewn seams connecting the one or more integrated containment compartments and/or devices to the woven geotextile fabric product.

29. The woven geotextile fabric product of claim 22, wherein warp ends are manipulated during in-line weaving on the loom by intermittently altering the weave pattern so that fabric formation transitions from a single woven layer to two or more woven layers for a distance and then transitions back to a single woven layer, thereby defining the one or more integrated containment compartments and/or devices by the two or more woven layers.

30. The woven geotextile fabric product of claim 22, wherein:

the one or more integrated containment compartments and/or devices are defined by two or more layers of woven fabric intermittently woven from the warp yarns and weft yarns; and/or the one or more integrated containment compartments and/or devices comprise a plurality of integrated open-ended pockets or sleeves integrally woven within the woven geotextile fabric product and spaced apart from each other along a length of the woven geotextile fabric product; and/or the warp yarns and weft yarns comprises polypropylene yarn and/or a UV-stabilized yarn system; and/or the one or more integrated containment compartments and/or devices are integrally woven in a cross-machine direction along the woven geotextile fabric product.

31. The woven geotextile fabric product of claim 22, wherein:

the woven geotextile fabric product comprises a woven silt fence including the one or more integrated containment compartments and/or devices integrally woven within the woven silt fence; and the one or more integrated containment compartments and/or devices are configured to slidably receive one or more support posts therein;

whereby the one or more support posts are configured to be slidably positioned within corresponding ones of the one or more integrated containment compartments and/or devices and driven into the ground for supporting the woven silt fence without requiring any fasteners for attachment of the one or more support posts to the woven silt fence and without having to manually add any separate pockets for the one or more support posts to the woven silt fence.

32. A method comprising weaving, on a loom, interlaced warp yarns and weft yarns together to thereby provide a woven geotextile fabric product having one or more integrated containment compartments and/or devices integrally woven within the woven geotextile fabric product, wherein the method includes:

weaving the warp yarns and weft yarns together in a single operation on the loom to thereby provide the woven geotextile fabric product having the one or more integrated containment compartments and/or devices integrally woven within the woven geotextile fabric product during the single operation on the loom; and/or weaving the warp yarns and weft yarns together in-line on the loom to thereby provide the woven geotextile fabric product having the one or more integrated containment compartments and/or devices integrally woven within the woven geotextile fabric product during the in-line weaving on the loom.

33. The method of claim 32, wherein the one or more integrated containment compartments and/or devices are configured for slidably receiving one or more support members therein.

34. The method of claim 32, wherein the one or more integrated containment compartments and/or devices are configured for receiving and containing a construction fill material therein.

35. The method of claim 34, wherein the one or more integrated containment compartments and/or devices are configured for receiving and containing stone fill, a sand/soil fill, or a combination thereof.

36. The method of claim 32, wherein the woven geotextile fabric product comprises a filtration fabric, an erosion control fabric, and/or a woven industrial fabric.

37. The method of claim 32, wherein the one or more integrated containment compartments and/or devices comprise one or more of a pocket, a sleeve, a frame, a bastion, and/or a basket.

38. The method of claim 32, wherein the method includes weaving the warp yarns and weft yarns such that the woven geotextile fabric product having the one or more integrated containment compartments and/or devices is provided as a single woven component that integrally includes the woven geotextile fabric product and the one or more integrated containment compartments and/or devices integrally woven together, without having to manually add the one or more integrated containment compartments and/or devices separately to the woven geotextile fabric product after weaving of the woven geotextile fabric product.

39. The method of claim 32, wherein the method includes integrally weaving the one or more integrated containment compartments and/or devices within the woven geotextile fabric product while the woven geotextile fabric product is being initially woven from the warp yarns and weft yarns such that transition points between the woven geotextile fabric product and the one or more integrated containment compartments and/or devices do not include any manually applied staples or sewn seams connecting the one or more integrated containment compartments and/or devices to the woven geotextile fabric product.

40. The method of claim 32, wherein the method includes altering a weave pattern intermittently during an initial weaving of the warp yarns and weft yarns into the woven geotextile fabric product such that the warp yarns and weft yarns define the one or more integrated containment compartments and/or devices integrally woven within the woven geotextile fabric product.

41. The method of claim 32, wherein the method includes manipulating warp ends during weaving on the loom by intermittently altering the weave pattern so that fabric formation transitions from a single woven layer to two or more woven layers for a distance and then transitions back to a single woven layer, whereby the one or more integrated containment compartments and/or devices are defined by the two or more woven layers.

42. The method of claim 32, wherein the method includes intermittently weaving the warp yarns and weft yarns such that the one or more integrated containment compartments and/or devices are defined by two or more layers of the fabric intermittently woven from the yarns.

43. The method of claim 32, wherein:

the method includes weaving the warp yarns and weft yarns together to thereby provide a plurality of integrated containment compartments and/or devices integrally woven within the woven geotextile fabric product and spaced apart from each other along a length of the woven geotextile fabric product; and/or the method further comprises producing and preparing the warp yarns and weft yarns before weaving the warp yarns and weft yarns to thereby provide the woven geotextile fabric product having the one or more integrated containment compartments and/or devices integrally woven within the woven geotextile fabric product.

44. The method of claim 32, wherein the method includes weaving the warp yarns and weft yarns together to thereby provide a woven silt fence having the one or more integrated containment compartments and/or devices integrally woven within the woven silt fence, the one or more integrated containment compartments and/or devices configured for receiving one or more support posts therein.

* * * * *